United States Patent [19]

Tatsumi et al.

[11] 4,176,942

[45] Dec. 4, 1979

[54] ELECTROPHOTOGRAPHIC COPYING APPARATUS

[75] Inventors: Susumu Tatsumi; Shoji Kuroishi, both of Tokyo, Japan

[73] Assignee: Ricoh Company, Ltd., Tokyo, Japan

[21] Appl. No.: 763,175

[22] Filed: Jan. 27, 1977

[30] Foreign Application Priority Data

Feb. 2, 1976 [JP] Japan ..... 51-10185

[51] Int. Cl.[2] ..... G03G 15/00; G03G 15/10

[52] U.S. Cl. ..... 355/14 R; 118/647; 355/10

[58] Field of Search ..... 355/3 R, 10, 14; 118/647, 648, DIG. 23

[56] References Cited

U.S. PATENT DOCUMENTS

| | | | |
|---|---|---|---|
| 3,892,481 | 7/1975 | Schaefer et al. | 355/10 |
| 4,021,111 | 5/1977 | Kuroishi et al. | 355/10 |
| 4,035,069 | 7/1977 | Yano | 355/3 R |
| 4,050,806 | 9/1977 | Miyakawa et al. | 355/10 X |
| 4,087,171 | 5/1978 | Yano | 355/10 X |

*Primary Examiner*—Fred L. Braun
*Attorney, Agent, or Firm*—Frank J. Jordan

[57] ABSTRACT

A photoconductive drum is electrostatically charged and radiated with a light image of an original document to produce an electrostatic image. A toner substance is applied to the drum to produce a toner image which is transferred and fixed to a copy sheet. A bias electrode is provided adjacent to the drum during the toner development stage to which is applied a bias voltage selected to prevent application of toner to white or background areas of the electrostatic image. The bias voltage is produced as a function of the sensed electrostatic potential of the electrostatic image and is automatically limited to prevent image degradation and loss of density. To reproduce photographs or low contrast documents such as diazo copies, the bias voltage is limited to a lower value to increase the image density and prevent dark areas from appearing washed out. The light image intensity is increased for reproduction of documents having colored backgrounds so that the backgrounds will reproduce white.

10 Claims, 2 Drawing Figures

ELECTROPHOTOGRAPHIC COPYING APPARATUS

BACKGROUND OF THE INVENTION

The present invention relates to an improved electrophotographic copying apparatus.

In an electrophotographic copier employing semi-moist development, a liquid toner substance is applied to a photoconductive drum to develop an electrostatic image of an original document formed thereon. A bias electrode is provided closely adjacent to the drum at the developing unit to which is applied a bias voltage of the same polarity as the electrostatic image on the drum. The potential of the bias voltage is selected to be slightly higher than the potential of white or background areas of the electrostatic image on the drum to prevent toner particles from being attracted to the background areas. This prevents the edge effect and ensures that the background areas will reproduce white.

However, it is difficult to select the proper bias voltage due to the great difference in original documents which must be reproduced. The proper bias voltage is a function of the density, contrast, image size and ratio of dark to light image areas of the document. Several types of systems have been proposed which automatically sense the average potential of the electrostatic image and adjust the bias voltage accordingly, thereby relieving the apparatus operator of this rather difficult task.

In one type of such system, the potential of the electrostatic image is sensed by means of an appropriately placed electrode and applied to an operational amplifier, which produces the bias voltage at its output. In another system the bias voltage is electrostatically induced on the bias electrode by the electrostatic image on the drum. However, even where various manual adjustments are provided to these systems they fail to provide copies of usable quality from certain kinds of documents.

Copies of photographs are often unsatisfactory since the dark areas appear washed out. Reproductions of diazo copies, which have low contrast, are often unreadable since the dark areas cannot be distinguished from the background areas. Copies of original documents having colored backgrounds are often unreadable since both the dark areas and the background reproduce with almost the same density. Whereas original documents have large dark areas, copies thereof often appear washed out and have low resolution. The latter problem is caused by an erroneously high bias voltage applied to the bias electrode.

SUMMARY OF THE INVENTION

The present invention overcomes the problems of the prior art by selectively adjusting the intensity of a light image radiated onto a photoconductive drum and limiting the bias voltage applied to a bias electrode to certain maximum values. For documents having colored backgrounds, the intensity of the light image is increased which causes the backgrounds to print white. For these documents, as well as for normal documents such as printed pages, the bias voltage is limited to a certain value to prevent image degradation and washout when copying documents with large dark areas. For photographs and low contrast documents, the bias voltage is limited to a lower value which increases the image density, prevents washout of the dark areas and improves the legibility of reproductions of diazo copies and other low contrast documents.

It is an object of the present invention to provide an electrophotographic copying apparatus which produces high quality copies of a wide range of original documents which cannot be satisfactorily copied by apparatus available heretofore.

It is another object of the present invention to provide a generally improved electrophotographic copying apparatus.

Other objects, together with the foregoing, are attained in the embodiments described in the following description and illustrated in the accompanying drawing.

DESCRIPTION OF THE PREFERRED EMBODIMENTS

While the electrophotographic apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
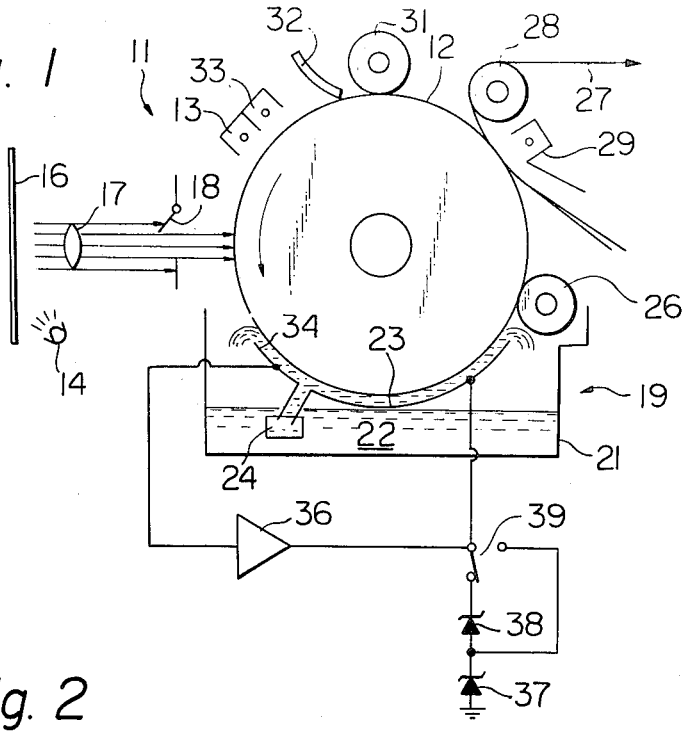
FIG. 1 is a schematic diagram of a first embodiment of an electrophotographic copying apparatus according to the present invention.

Referring now to FIG. 1 of the drawing, an electrophotographic copying apparatus embodying the present invention is generally designated by the reference numeral 11 and comprises a drum 12 which is driven for counterclockwise rotation at constant speed. Typically, the drum 12 comprises a grounded metallic core on which is formed a photoconductive layer of a suitable material such as selenium. A corona charging unit 13 is designed to uniformly charge the surface of the drum 12 with a high positive electrostatic potential. A lamp 14 illuminates the surface of an original document 16 for reproduction which is scanningly moved relative to the drum 12 by any known means in a synchronous manner. An optical system symbolically represented by a converging lens 17 focusses a light image of the document 16 onto the surface of the drum 12 through an adjustable slit 18. The light image causes localized photoconduction of the photoconductive layer on the drum 12 resulting in the formation of an electrostatic image thereon.

A developing unit 19 comprises a developing tank 21 filled with a developing or toner substance 22 in liquid form. Above the developing tank 21 is provided an arcuate bias electrode 23 in close proximity with the drum 12. The toner substance 22 is pumped by means of a pump 24 into the space between the bias electrode 23 and drum 12 to completely fill the same. Excess toner substance 22 spills over the ends of the bias electrode 23 into the tank 21 for recycling.

The toner substance 22 adheres to high potential areas of the drum 12 due to electrostatic attraction in a manner which is well known in the art to form a visible toner image on the drum 12. Excess toner substance 22 is removed from the drum 12 by means of a doctor roller 26 and returned to the developing tank 21.

A sheet 27 of copying paper is fed in contact with the drum 12 by a feed roller 28. A transfer charger 29 applies an electrostatic potential of the same polarity as the electrostatic image on the drum 12 to the back of the sheet 27 which attracts the toner image from the drum 12 onto the sheet 27. Subsequently, a fixing unit which is not shown fixes the toner image to the sheet 27 by means of heat, pressure or a combination thereof to provide a permanent copy of the original document 16.

A cleaning roller 31 in combination with a scraper blade 32 removes any residual toner substance 22 from the drum 12. A corona discharging unit 33 then discharges the drum 12 in preparation for another copying cycle.

In accordance with the present invention, a sensing electrode 34 is provided adjacent to the drum 12 at the upstream end of the bias electrode 23. A positive electrostatic potential corresponding to the potential of the electrostatic image on the drum 12 is induced onto the sensing electrode 34 and applied to an input of an electronic operational amplifier 36. The output of the operational amplifier 36 is connected to the bias electrode 23 so that the output voltage of the operational amplifier 36 is impressed on the bias electrode 23 as a bias voltage. The operational amplifier 36 is designed so that the bias voltage is slightly higher than the potential of the white or background areas of the electrostatic image on the drum 12. This attracts the toner substance 22 away from these white areas. If the toner substance 22 were allowed to adhere to the white image areas, these areas would reproduce gray.

The anode of a zener diode 37 is grounded and the cathode thereof is connected to the anode of a zener diode 38. A switch 39 is provided to connect the bias electrode 23 to either the cathode of the zener diode 38 or the cathode of the zener diode 37. In this exemplary embodiment, the zener diodes 37 and 38 each have zener breakdown voltages of 200 V. Both the switch 39 and the adjustable slit 18 are actuated by a three position knob on the panel of the apparatus 11, which is not shown in the drawing. A "normal" position of the knob is selected for copying normal documents such as printed pages. The knob also has a "darken" position and a "lighten" position as will be described in detail below.

For copying normal documents, the adjustable aperture 18 is opened to a width of typically 8 mm and the switch 39 connects the bias electrode 23 to the cathode of the zener diode 38. It will be appreciated that the zener diodes 37 and 38 are in this manner connected in series across the output of the operational amplifier 36 and that the zener breakdown voltage of the series combination is 400 V. If a normal document having an extremely large dark image area is copied, and the output of the operational amplifier 36 which constitutes the bias voltage on the bias electrode 23 reaches 400 V, the zener diodes 37 and 38 will conduct so that the bias voltage is not allowed to exceed 400 V. This prevents an erroneously high bias voltage from being applied to the bias electrode 23 which would cause washout of the dark image areas and a general degradation of image quality and resolution.

For copying documents having colored backgrounds, the knob is moved to the "lighten" position. The switch 39 connects the bias electrode 23 to the cathode of the zener diode 38 as in the normal position but the adjustable slit 18 is opened to a width of typically 12 mm.

The problem in copying documents with colored backgrounds is that the photoconductive substances in general use have low sensitivity to most colors. This causes the colored background areas to reproduce almost as dense as the dark or black areas so that these areas cannot be distinguished from each other. Increasing the intensity of the light image reduces the density of the copy which increases the contrast between the background and dark areas and greatly improves the quality of the copy.

To reproduce photographs or low contrast documents such as diazo copies, the knob is moved to the "darken" position, in which the adjustable slit 18 is opened to 8 mm, the same width as with the knob in the "normal" position. However, the switch 39 is changed over so that the bias electrode 23 is connected to the cathode of the zener diode 37 and the bias voltage is limited to 200 V. This causes a general increase in the density of the reproduced image which prevents the dark image areas of photographs from being washed out and increases the contrast between light and dark areas of reproductions of low contrast originals such as diazo copies. In this manner, the automatic bias system in combination with selected manual controls and the novel provision of means for limiting the maximum bias voltage applied to the bias electrode 23 enables high quality copies to be produced of documents which cannot be satisfactorily copied using copying machines commercially available heretofore.

Figure 2:
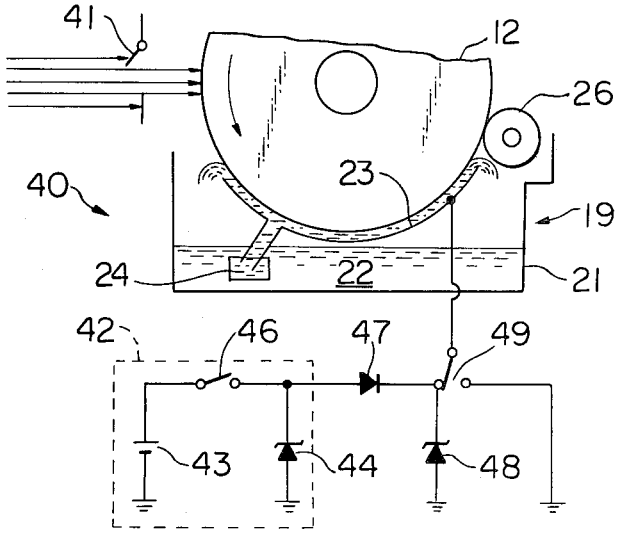
FIG. 2 is similar to FIG. 1 but shows a second embodiment.

FIG. 2 shows another embodiment of an electrophotographic copying apparatus 40 of the present invention in which like elements are designated by the same reference numerals. An adjustable slit 41 is essentially similar to the slit 18 but is arranged to be opened to different widths as will be described below.

In this embodiment the operational amplifier 36 is omitted and the bias voltage is electrostatically induced on the bias electrode 23 by the electrostatic image on the drum 12. This is referred to as a "floating bias" system, and the magnitude of the potential on the bias electrode 23 depends on the magnitude of the electrostatic image potential.

A voltage source 42 comprising a battery 43 and a zener diode 44 is designed to produce a voltage of 120 V. More specifically, the battery 43 voltage is somewhat greater than 120 V. The zener breakdown voltage of the zener diode 44 is 120 V so that the zener diode 44 conducts and maintains 120 V thereacross. A switch 46 is provided between the battery 43 and zener diode 44.

The cathode of the zener diode 44 is connected to the anode of a clamping diode 47, the cathode of which is connected to the cathode of a zener diode 48 having a zener breakdown voltage of 240 V. The anode of the zener diode 48 is grounded. A switch 49 selectively connects the bias electrode 23 to the cathode of the zener diode 48 or ground.

The principle of the embodiment of FIG. 2 is similar to that of FIG. 1. In the "normal" position of a knob (not shown) of the apparatus 40, the adjustable slit 41 is opened to 12 mm and the switch 49 connects the bias electrode 23 to the cathode of the zener diode 48. The switch 46 is closed connecting the battery 43 to the zener diode 44 so that a voltage of 120 V is maintained at the anode of the clamping diode 47. If the bias voltage reaches 240 V, the zener diode 48 conducts to prevent the bias voltage from exceeding 240 V. If the bias voltage drops to 120 V, the clamping diode 47, which is reverse biased when the bias voltage is above 120 V, conducts, thereby clamping the battery 43 to the bias electrode 23 and preventing the bias voltage from dropping below 120 V. In this manner, the bias voltage is maintained within a range of 120 V to 240 V.

In this regard, it is to be noted that when an original document having colored background is reproduced at the "lighten" position in the floating bias system as shown in FIG. 2, the very low bias voltage is critically induced, causing toner particles to be attracted to the background area of the electrostatic image on the drum. Accordingly, in order to eliminate the disadvantage, the bias voltage is prevented from dropping below 120 V because the electrostatic potential of the electrostatic image on the drum is approximately equal to but lower than 120 V.

When the knob is moved to the "lighten" position, the switches 46 and 49 remain in the same positions as for normal copying. However, the adjustable slit 41 is opened to 15 mm to lighten the copy and provide contrast between the colored background and dark areas as in the above embodiment.

With the knob moved to the "darken" position, the adjustable slit 41 is opened to the same width of 12 mm as for normal copying. However, the switch 49 connects the bias electrode 23 to ground and the switch 46 opens thereby disconnecting the battery 43 from the zener diode 44 and terminating current consumption by the zener diode 44. With the bias voltage reduced to zero, the copy density is increased preventing washout of dark areas as in the first embodiment.

In summary, it will be seen that the present invention overcomes the problems of copying original documents having colored backgrounds, photographs and low contrast documents such as diazo copies so that high quality reproductions can be produced of the documents. In addition, the present invention overcomes the problems of copying original documents with large dark image areas. Numerous modifications will become possible for those skilled in the art after receiving the teachings of the present disclosure without departing from the scope thereof. For example, the invention may be adapted for utilizing a dry rather than a semi-moist development system.

What is claimed is:

1. An electrophotographic apparatus comprising:

a photoconductive member;

charging means for electrostatically charging the photoconductive member;

imaging means for radiating a light image of an original document onto the photoconductive member to produce an electrostatic image thereon;

developing means for applying a toner substance to the photoconductive member to develop the electrostatic image into a toner image;

a bias electrode disposed adjacent to the photoconductive member;

light image intensity regulating means for regulating an intensity of the light image to a plurality of different intensities;

bias voltage producing means for producing a bias voltage which is applied to the bias electrode;

limiting means for limiting the bias voltage to a plurality of different bias voltages in accordance with an electrostatic potential of the electrostatic image on the photoconductive member; and control means for controlling the limiting means to limit the bias voltage to a first predetermined voltage which is lower than a bias voltage for normal document reproduction when the intensity of the light image is a first intensity which is equal to an intensity for normal document reproduction and controlling the light image intensity regulating means to limit the intensity of the light image to a second intensity which is higher than the first intensity when the bias voltage is a second predetermined voltage which is higher than the first predetermined voltage and equal to a bias voltage for normal document reproduction.

2. An apparatus as in claim 1, in which the control means comprises switch means connected to the limiting means, the apparatus further comprising light valve means controlled by the switch means to regulate an intensity of the light image to the first intensity when the limiting means limits the bias voltage to the first predetermined voltage and to the second intensity when the limiting means limits the bias voltage to the second predetermined voltage.

3. An apparatus as in claim 2, in which the control means comprises a sensing electrode provided adjacent to the photoconductive member and electronic amplifying means having an input connected to the sensing electrode and an output connected to the bias electrode.

4. An apparatus as in claim 3, in which the limiting means comprises at least one zener diode.

5. An apparatus as in claim 2, in which the control means comprises the bias electrode, the bias voltage being electrostatically induced onto the bias electrode by the electrostatic image on the photoconductive member.

6. An apparatus as in claim 5, in which the limiting means is further constructed so as to, when controlled by the switch means to limit the bias voltage to the second predetermined voltage so that the intensity of the light image is higher than the intensity for normal document reproduction, prevent the bias voltage from dropping below a third predetermined voltage which is lower than the second predetermined voltage.

7. An apparatus as in claim 6, in which the third predetermined voltage is higher than the first predetermined voltage.

8. An apparatus as in claim 7, in which the limiting means comprises a voltage source producing the third predetermined voltage, a zener diode having a zener voltage equal to the second predetermined voltage and a clamping diode connected between the voltage source and the zener diode.

9. An apparatus as in claim 2, in which the limiting means comprises two zener diodes, the switch means selectively connecting the bias electrode to the zener diodes.

10. An apparatus as in claim 9, in which the switch means selectively connects the bias electrode across one of the zener diodes to limit the bias voltage to the first predetermined voltage and across both of the zener diodes in series to limit the bias voltage to the second predetermined voltage.

* * * * *